United States Patent [19]

Harlan

[11] Patent Number: 4,795,150

[45] Date of Patent: Jan. 3, 1989

[54] STRETCHING APPARATUS

[75] Inventor: Sven Harlan, Norwalk, Conn.

[73] Assignee: Ballet Design, Inc., Norwalk, Conn.

[21] Appl. No.: 112,262

[22] Filed: Oct. 22, 1987

[51] Int. Cl.[4] ..... A63B 23/04

[52] U.S. Cl. ..... 272/144; 272/903; 269/17; 128/25 R; 128/25 B

[58] Field of Search ..... 272/93, 96, 134, 126, 272/144, 903; 128/25 R, 25 B, 71; 269/325, 17

[56] References Cited

U.S. PATENT DOCUMENTS 2,021,801 11/1935 Meyer ..... 272/96
4,086,921 5/1978 Gonzales et al. ..... 128/25 B
4,456,247 6/1984 Ehrenfried ..... 272/126
4,531,730 7/1985 Chenera ..... 272/126
4,665,899 5/1987 Farris et al. ..... 128/25 R

*Primary Examiner*—Richard J. Apley
*Assistant Examiner*—S. R. Crow
*Attorney, Agent, or Firm*—Cooper & Dunham

[57] ABSTRACT

A muscle stretching apparatus for stretching the lower body muscles of a person straddling two hinged body-support platforms. A motor-driven extension tube connects at each end to the platforms and contracts or expands the angle between the platforms while straddled by a person. The apparatus includes cycling capabilities, angle measurement means and timer means.

8 Claims, 3 Drawing Sheets

4
5
11
12
13
14
16
17
19
20
21
25
26
28
30
31
34
36
39
51

STRETCHING APPARATUS

BACKGROUND OF THE INVENTION

The present invention relates to an apparatus and method for stretching human muscles.

Flexibility of muscles, particularly leg, hip, and back muscles, in the human body is desirous for several reasons. Increased flexibility enables increased performance in sports involving kicking such as the martial arts, and in those requiring fluid and graceful body movement such as dance, running and gymnastics. A flexible muscle is also less likely to become pulled, torn or otherwise injured during exercise.

Devices designed to stretch muscles are known. One simple device consists of two plastic or metal tubes joined end to end by a perpendicular shorter tube. An individual sits on the floor, straps the longer tubes to the legs, one on each ankle, and uses the shorter tube to pull the device toward the body, thus increasing the angle between the longer tubes, and forcing the legs apart, causing the leg muscles to become stretched. These devices typically do not automatically adjust, are inaccurate and may cause injury from a sudden jerk or pull on the center tube, causing the leg muscles to stretch too quickly. The position of the body with such devices is limited, and commonly only groin muscles are stretched.

Another known stretching device comprises two trough-shaped receptacles for legs, joined at the center by a mechanical locking mechanism. Body position in these devices is limited because the legs must fit into the troughs. Thus, only the groin muscles are stretched in these devices as well. There is also danger of injury to the muscles due to sudden jerking of the device into a locked position.

Other devices do automate stretching, for example the device shown in U.S. Pat. No. 4,531,730. However, the device disclosed in that patent is centermounted over a support assembly. It is cumbersome, unsightly and difficult to mount.

SUMMARY OF THE INVENTION

One object of the present invention is to provide a stretching apparatus for automated gradual stretching of many different muscles of the human body.

Another object of the invention is to provide a stretching apparatus which enables pre-programmed cycle stretching of many different muscles of the human body.

Still another object of the invention is to provide a stretching apparatus with side support which is more stable, easier to use and esthetically more attractive than center mounted devices.

The present invention is an improvement on the prior art, and discloses a novel stretching apparatus which is fully automatic, enabling gradual, precise stretching of the leg, hip and back muscles. Two wide body-support platforms joined end to end by a hinge enable the device to be used in many different positions and to stretch many different muscles in the body. The absence of a center-mount assembly facilitates safe mounting and dismounting, and gives the device a more sleek, compact appearance. A motor driven expansion and contraction device, together with a calibrated angle measurement device and timer, insure slow stretching for predetermined time periods and serve to prevent injury due to sudden jerking of the muscles.

For automatic cyclical stretching, the device can be put into CYCLE DOWN mode whereby the legs can be alternately stretched and relaxed several times. The device may be programmed to maintain a certain precise angle between the platforms for a predetermined time, then to decrease the angle for a predetermined time, and the cycle can be repeated. A CYCLE UP feature is also available, which enables cyclical stretching of the type described above, but for back muscles. In CYCLE UP and CYCLE DOWN modes the device emits audio signals for each minute the device remains stationary, enabling a user to keep track of stretching and resting time periods.

DETAILED DESCRIPTION OF THE INVENTION

Figure 1:
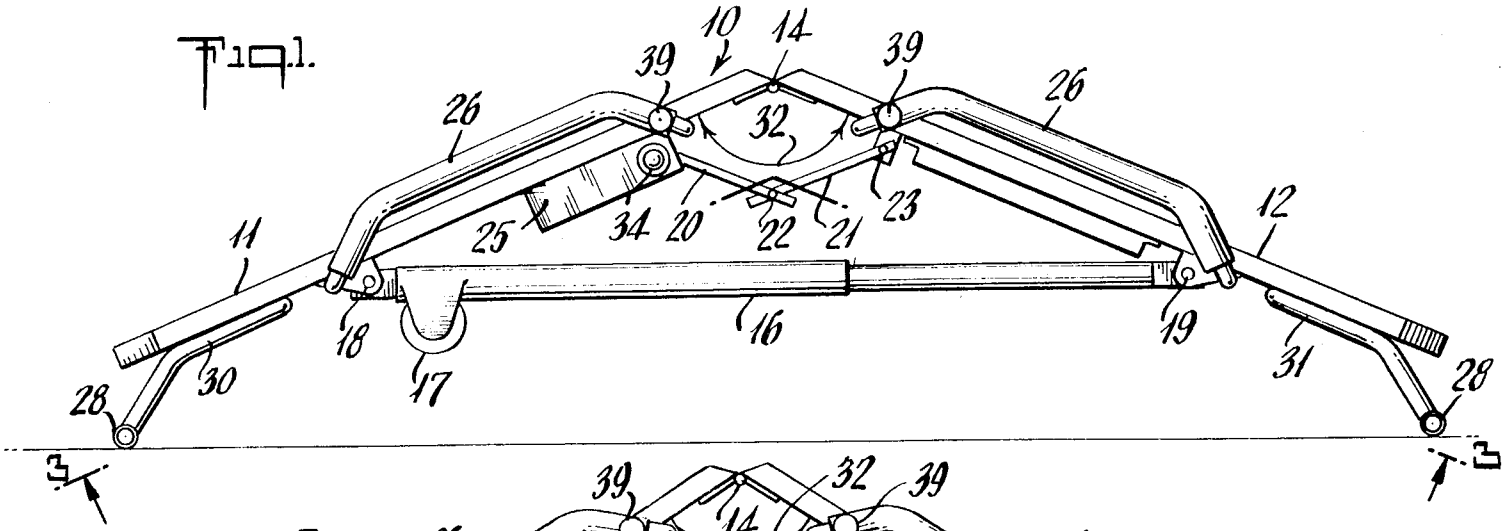
FIG. 1 is a side elevational view of an apparatus for stretching the muscles of the human body in accordance with the present invention, the apparatus shown in a neutral position.

Generally, as shown in FIG. 1 of the drawings, the present invention relates to stretching apparatus 10 comprising two body-support platforms 11 and 12. The platforms are made of plywood and are covered with vinyl and closed cell foam cushioning material. The platforms are joined end-to-end by hinge means 14. The hinge preferably is covered by a pad. The body-support platforms 11 and 12 are further connected midsection-to-midsection by a linear actuator comprising an extension tube 16, which is driven by a 115VAC motor 17 and is attached to the body-support platforms at pivot points 18 and 19. The body-support platforms 11, 12 are further connected at a location above the motor-driven extension tube 16 by connection rods 20, 21, whcih meet at pivot point 22. The connection rods 20, 21 are connected respectively to a flange 23 and a rotary resistor 24.

The rotary resistor 24 is partially housed in control box 25 and calibrated using a known angle of movement. Connected to both sides of the body-support platforms 11, 12 are handle means 26. Sliders 28 are connected to legs 30, 31 of the respective body-support platforms 11, 12.

Figures 3, 4, 5:
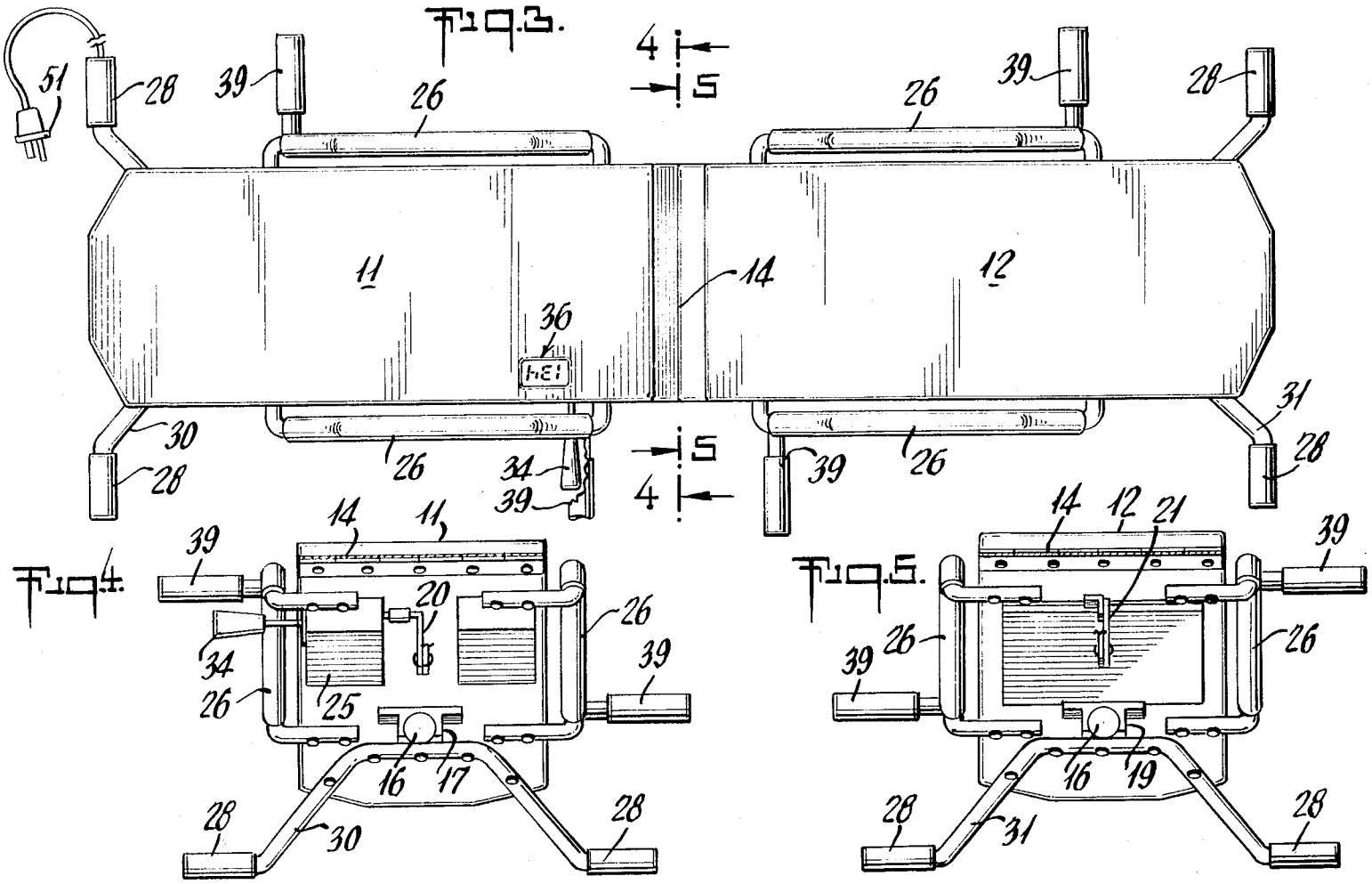
FIG. 3 is a top plan view of the stretching apparatus.
FIG. 4 is a cross-sectional view of the stretching apparatus taken along the line 4—4 in FIG. 3.
FIG. 5 is a cross-sectional view of the stretching apparatus taken along the line 5—5 in FIG. 3.

Control stick 34, as seen in FIGS. 3 and 4, is connected to motor 17 which causes extension tube 16 to expand or contract. Control stick 34 is mounted to control box 25. Motor 17 also is mounted to the underside of body - support platform 11. Display means 36 electronically displays the measurement of an angle 32 between body - support platforms 11, 12, as determined by rotary resistor 24. The display means is digital and may be of the liquid-crystal or LED types.

Figure 2:
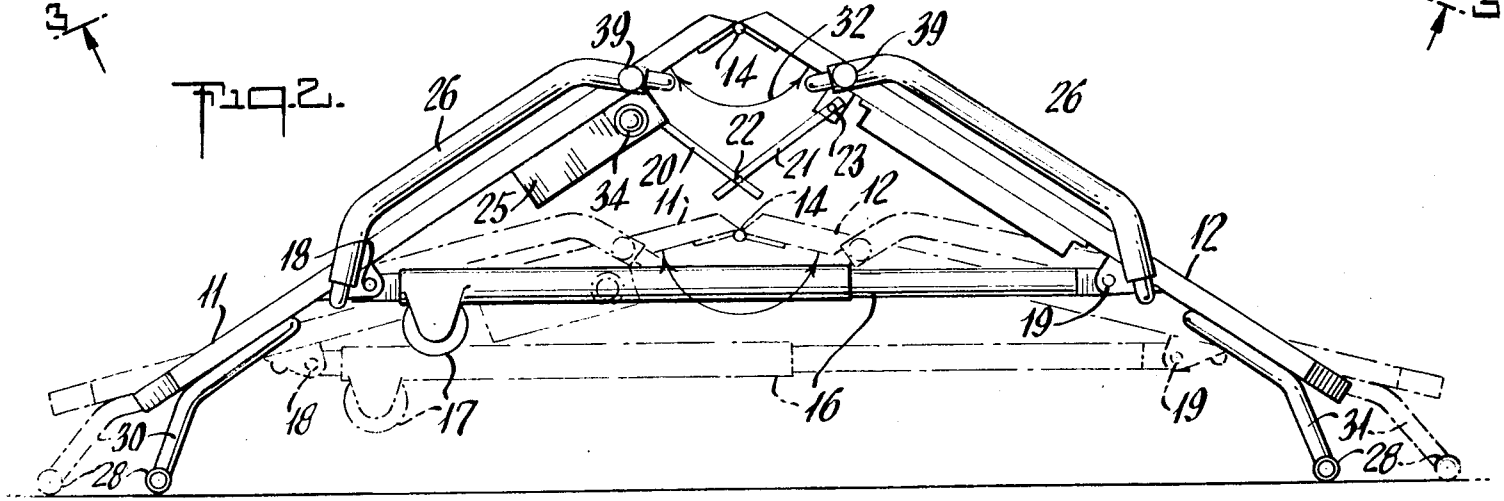
FIG. 2 is a side elevational view of the apparatus for stretching the muscles of the human body in the leg relaxing position, superimposed to show in phantom the apparatus in a leg stretching position.

As best seen in FIG. 2, the extension tube 16, when caused by motor 17 to expand into a stretching position (phantom lines), causes the angle 32 between the body-support platforms 11, 12 to increase, approaching 165°. In turn, this causes the body-support platforms 11, 12 to be pushed apart at the legs 30, 31. The legs 30, 31 of the body-support platforms 11, 12 move outwardly along the floor on the sliders 28. Expansion of extension tube 16 further causes connection rods 20, 21 to be pulled outward from each other such that the rods approach a common horizontal plane. Outward movement of the connection rods 20, 21 causes the rod 20 connected to rotary resistor 24 to rotate about the rotary resistor. The resistor 24 will, therefore, at any given moment, represent the precise angle 32 between the body-support platforms 11, 12.

There is also shown in FIG. 2 the position of the apparatus 10 is a relaxing position (solid lines). Thus, when motor 17 causes the extension tube 16 to contract, the angle 32 between the body-support platforms 11, 12 decreases, approaching 75°. This, in turn, causes the body-support platforms 11, 12 to move toward each other at the legs 30, 31 which move inwardly on the rollers or slides 28. Contraction of extension tube 16 causes connection rods 20, 21 to be pulled inward toward an acute angle. Movement of the connection rods 20, 21 causes the rod 20 to rotate about the rotary resistor 24. The resistor 24 then will represent the angle 32 between the body-support platforms 11, 12.

Figures 6, 7:
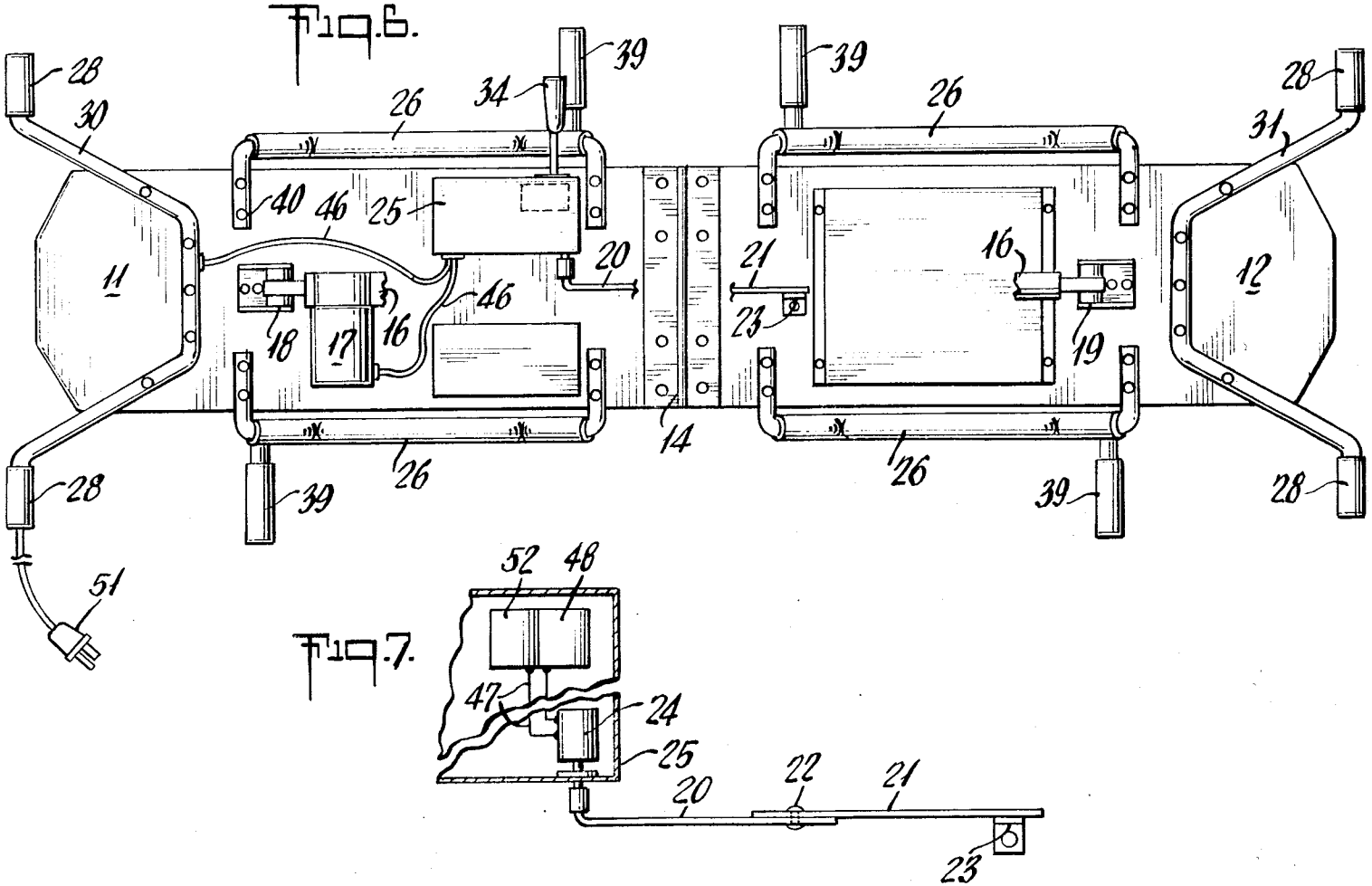
FIG. 6 is a bottom view of the stretching apparatus.
FIG. 7 is a view, partially broken away, of the control box displaying the rotary resistor housed therein.

Handle means 26 are made of steel and covered in vinyl or other cushioning material and fixed to both sides of body-support platforms 11, 12. The handle means enable the user to readily mount and dismount the apparatus and to maintain balance. Steel steps 39 also are covered in rubber or other cushioning material, and are fixed to handle means 26 on opposite sides of the device to facilitate mounting and dismounting by a user. As seen in FIG. 6, handle means 26 and legs 30, 31 are mounted to the undersides of the body-support platforms 11, 12 by screws 40.

The undersides of the body-support platforms 11, 12 are best seen in FIGS. 4, 5 and 6. Motor 17 and one end of extension tube 16 are secured to body-support platform 11 by a mounting bracket and bearing 44. Lead 46 connects motor 17 to control stick 34. Control stick 34 is fixed to control box 25. Rotary resistor 24 also is mounted within control box 25. As seen in FIG. 7, rotary resistor 24 is connected by leads 47 to electronic recorder 48. As connection rod 20 turns about rotary resistor 24, electronic recorder 48, reads angle measurements represented by calibrations of rotary resistor 24. On the other body-support platform 12, the opposite end of extension tube 16 is connected to the underside by mounting bracket and bearing 50. Connection rod 21 is mounted to flange 23. Connection rod 21 forms an angle with connection rod 20 at point 22. Power cord 51 connects the controls to a suitable electrical source (not shown).

A timer 52 is mounted in the control box 25 on the underside of body-support platform 11. The timer measures the number of minutes that the platforms have remained in a set position. The timer is reset each time the angle of the platforms is changed. The timer generates an electronic signal each minute, for three minutes, if the angle is not changed. The timer is inoperative when the apparatus is used in the UP CYCLE or DOWN CYCLE modes.

In use of the apparatus 10, control stick 24 is used to change the positions of the body-support platforms 11, 12. Moving the control stick to the "up" position causes the platforms to rise. The platforms will continue to rise until the control stick is returned to the "off" position or until they reach their highest position. Moving the control stick to the "down" position causes the platforms to lower. The platforms will continue downwardly until the control stick is returned to the "off" position or until they reach their lowest position.

The display 36 is mounted on the top of one of the body-support platforms, usually platform 11. The display shows the angle between the platforms. This is a measure of the flexibility of the user's legs or back. Full front or side splits have an angle of about 180°. A normal stretching position for front splits and side splits is an angle of between 111° and 140°. A normal angle for a back stretch is between about 95° and 119°. An excellent stretching position for front and side splits is 165° or greater. An excellent stretching position for back stretching is an angle of less than about 77°. The display shows a range of about 75° to 165°.

In order to lengthen a muscle, it must be relaxed. Leg muscles should not be supporting the body at the same time they are being stretched. At first, an angle should be chosen by the user which allows both legs to be straight and fully supported by the platforms 11, 12. After a short initial stretching of the legs, the platforms should be lowered to a moderate or more difficult position. In that position, the legs are totally straight and completely flat on the platforms. this is best seen in FIG. 2.

To use the apparatus in the DOWN CYCLE mode for leg stretching, the control stick 34 is moved to that indication. The platforms then begin to rise, relaxing the stretch. After about 15 seconds, the platforms will begin to go downward, increasing the stretch. After about 12 seconds, the platforms again will begin to rise, decreasing the stretch. After 10 more seconds, the platforms will lower again. At this point, the legs are at about the same angle as when the cycle began. Each cycle after this increases the maximum stretch, because the platforms are lowered for a slightly longer time then when they are risen. Stretching should be discontinued when the user's maximum stretch is reached.

To use the apparatus for back stretching, a similar procedure is employed. However, increased stretch results from decreasing the angle 32, rather than increasing it. The UP CYCLE mode is used for stretching the back. In that mode, the angle is decreased slightly with each cycle to increase the stretch on the back.

The apparatus of the invention has been found particularly useful for the following stretching positions: front leg splits, side leg splits, hip socket stretches, back stretches, shoulder stretches, and calf and achilles tendon stretches. Other uses of the apparatus will be apparent to those skilled in the art.

The invention has been described in connection with the preferred embodiment. It should be appreciated that various modifications could be made to the apparatus and its method of operation without departing from the spirit and scope of the invention.

I claim:

1. A muscle stretching apparatus for stretching the lower body muscles of a user when in a straddling or lying position, said apparatus comprising:

(a) two body-support platforms connected end-to-end at an angle and arranged such that a user lies or sits on top sides of both platforms;

(b) a motor-driven extension tube connected at each end to undersides of the respective body-support platforms and adapted to contract or expand the angle between the platforms with respect to each other while being occupied by a user;

(c) control means for causing contraction or expansion of the motor-driven extension tube; and (d) angle measurement means connected to the respective body-support platforms for permitting the user to determine the angle between the respective platforms before and after expansion or contraction thereof, whereby upon expansion or contraction of the angle between the platforms, the user's muscles are stretched or relaxed.

2. Apparatus according to claim 1, wherein said angle measurement means comprises a rotary resistor attached to the underside of one body-support platform and having a first connection rod connected at one end thereof, said first connection rod being attached at the opposite end thereof to a second connection rod at one end thereof, said second connection rod being secured at the opposite end thereof to the underside of the second body-support platform, said first connection rod being arranged to rotate said rotary resistor when the angle between the respective platforms is changed.

3. Apparatus according to claim 1, further comprising a control stick which activates expansion and contraction of said motor-driven extension tube.

4. Apparatus according to claim 1, further comprising timer means for permitting measurement of the amount of time the angle between said body-support platforms remains constant.

5. Apparatus according to claim 1, further comprising means for emitting an audio signal at the end of a predetermined time period the angle remains constant.

6. Apparatus according to claim 1, further comprising handle means for support of a user and connected to at least one of said body-support platforms.

7. Apparatus according to claim 1, further comprising display means permitting display of measurements determined by said angle measurement means.

8. Apparatus according to claim 1, further comprising means mounted on the lowermost portions of said body-support platforms permitting said body-support platforms to move across a floor or other surface.

* * * * *